US006702606B2

(12) United States Patent
Bolliger

(10) Patent No.: US 6,702,606 B2
(45) Date of Patent: Mar. 9, 2004

(54) ELECTRICAL CONNECTION DEVICE

(75) Inventor: Roman Marcel Bolliger, Allschwil (CH)

(73) Assignee: Woertz AG, Muttenz (CH)

( * ) Notice: Subject to any disclaimer, the term of this patent is extended or adjusted under 35 U.S.C. 154(b) by 108 days.

(21) Appl. No.: 09/941,624

(22) Filed: Aug. 30, 2001

(65) Prior Publication Data

US 2002/0028598 A1 Mar. 7, 2002

(30) Foreign Application Priority Data

Sep. 5, 2000 (CH) ..... 1725/00

(51) Int. Cl.[7] ..... H01R 4/24
(52) U.S. Cl. ..... 439/425; 439/418
(58) Field of Search ..... 439/425, 418, 439/411, 422, 416, 412, 413, 414, 417, 419, 431, 391

(56) References Cited

U.S. PATENT DOCUMENTS 2,353,778 A * 7/1944 Mattis ..... 439/425
3,720,778 A * 3/1973 Woertz et al. ..... 174/59
4,365,859 A * 12/1982 Hutter et al. ..... 439/425
4,878,855 A * 11/1989 Heng et al. ..... 439/411

* cited by examiner

*Primary Examiner*—P. Austin Bradley
*Assistant Examiner*—Ross Gushi

(57) ABSTRACT

The electrical connecting element for a connecting of fine wire cables (strands) consists of a contact pin having preferably points at both its ends and a radially projecting abutment flange on the shaft of the pin which contact pin penetrates through insulations. A shoulder between tip and shaft ensures that the pin which has been pressed in can not be torn out and the flange acts for a limiting of the depth of penetration.

3 Claims, 1 Drawing Sheet

ELECTRICAL CONNECTION DEVICE

BACKGROUND OF THE INVENTION

1. Field of the Invention

The present invention relates to a device for a providing of a electrically conducting connection with a fine wire core lead in a cable, specifically a flat band cable and especially to a device for a forming of a electrically conducting connection between fine wire core leads in cables arranged superposed over each other, specifically flat band cables.

2. Description of the Prior Art

In order to provide electrical connections of the kind described above a great variety of more or less complicated devices, such as for instance connection or junction boxes have become known.

SUMMARY OF THE INVENTION

Hence, it is a general object of the present invention to provide a substantially simpler electrical and mechanical device for a connection with or between, respectively, fine wire leads in cables, specifically flat band cables, whereby the connection device should lend itself to produce a connection safely and very fast also in a smallest space.

A further object is to provide a device for providing a electrically conducting connection with a fine wire core lead in a cable which includes a nail shaped contact pin having a pin shaft with a pin shaft diameter, and having at least one pin point ending at a pin point base with a base diameter, which base diameter exceeds the pin shaft diameter thus forming a shoulder at the pin, which contact pin includes further a abutment flange located at a predetermined distance from the pin point by means of which abutment flange a depth of penetration of the contact pin is determined.

Such device is useful for a single connection to a lead.

Still a further object is to provide a device for providing of a electrically conducting connection between fine wire core leads of cables located on top of each other, specifically flat band cables, in which the shaft ends at both its ends at a pin point having a pin point base with a base diameter which exceeds the diameter of the shaft.

The solution according to the invention is also substantially made possible because the present cables are produced extremely precisely (precise position of the cores of the leads and their insulation in the cable jacket).

BRIEF DESCRIPTION OF THE DRAWING

The present invention will be better understood and objects other than those set forth above, will become apparent when consideration is given to the following detailed description thereof. Such description makes reference to the annexed drawings wherein.

DESCRIPTION OF THE PREFERRED EMBODIMENTS

Figure 1:
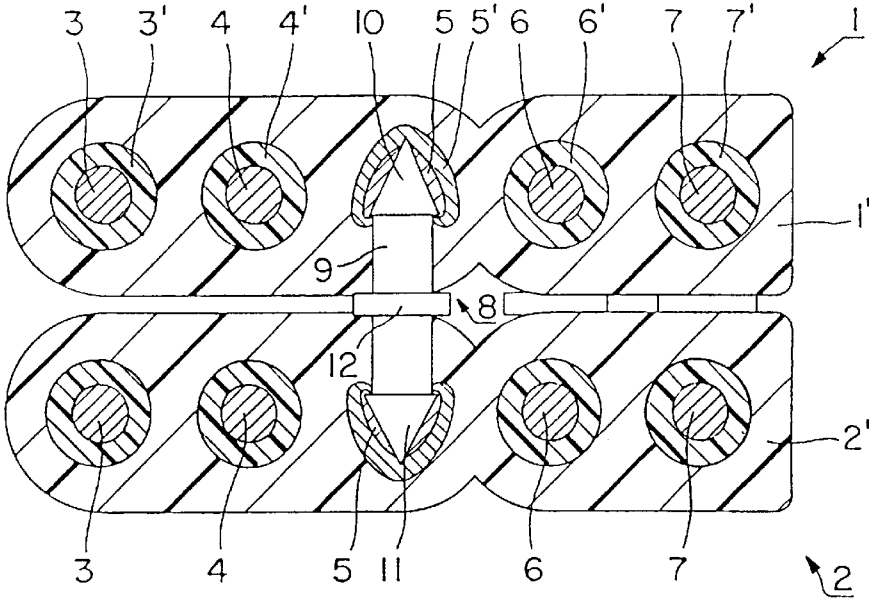
FIG. 1 is a section through two five-core flat band cables located on top of each other and with a device for a connecting of the core leads according to the invention.

FIG. 1 of the drawing illustrates two flat band cables 1, 2 located on top of each other, each having five conductor core leads (fine wire or wire strand leads) 3–7 which are enclosed by a core lead insulation 3'–7' and are embedded in the cable jacket 1' and 2', respectively.

In order to ensure a safe electrical connection of the leads 3—3, 4—4 . . . of the two cables 1, 2 electrically conducting (metallic) connection devices 8 are foreseen. These consist of a nail-shaped contact pin having at both Its ends a pin point 10, 11 and a pin shaft 9 located between these pin points 10, 11. The diameter of the base of the pin points is somewhat larger than the diameter of the pin shaft so that two shoulders are formed (see base 10*a* of pin point 10 in FIG. 3 and shoulder 10*b*).

A radially projecting flange 12 is located on the pin shaft 9 at a predetermined distance from the pin points 10, 11. The function of the shoulders at the base of the pin points and also of the flange is set forth in the following description:

In order to produce in the smallest space and within the shortest time a safe electrical and mechanical connection between fine wire strand flat band cables, the above-described connecting device (contact pin) has been developed. By means of a tool (not illustrated) the contact pins 8 for, e.g., a flat band wire cable 2 having five leads, are held at a correct distance from each other and are pressed thereafter by a (not illustrated) apparatus firstly into the one flat band wire cable 2, and thereafter the other flat band wire cable 1 is pressed onto the projecting contact pins 8. The points 10, 11 of the contact pins puncture the cable jacket 1' and the lead insulation 3'–7' and penetrate into the fine wire core 3–7 without, however, penetrating through the lead insulation 3'–7' at the opposite side. In order to prevent the flat band wire cables 1, 2 connected to each other in this way from sliding off the contact pins 8 after the pressing apparatus has been removed and the pressure of the pressing action has ceased, the diameter at the somewhat larger diameter at the base of the pin points 10, 11 act as a barb in the netting of the fine wire core lead 3–7. The leads from the main conductor to the branch conductors are connected electrically and mechanically and the flat band wire cables can not detach themselves on their own from the contact pins 8.

Because the "Geometric Properties" of the present day cables are known with a high precision, the depth of the penetration of the contact pin 8 can be set by a suitable arrangement of the flange 12 (so that the contact pin 8 penetrates only into the core leads 3–7, does however not penetrate through their insulation 3'–7' at the area of the points 10, 11 (after the pressing in).

Figure 2:
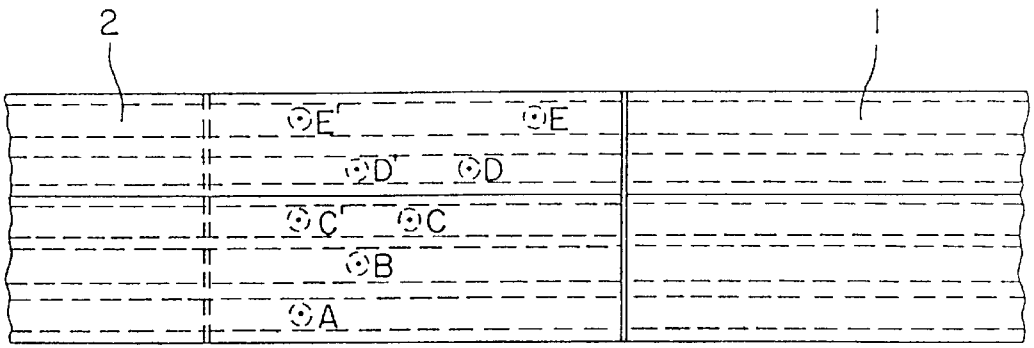
FIG. 2 illustrates purely schematically the possibilities if the arrangement of the points of connection for the connecting of all core leads.

FIG. 2 of the drawing illustrates (in comparison with FIG. 1 on a different scale) two possible arrangements of connecting devices for a connecting of the core leads of two five wire core cables A-B-C-D-E or A-B-C'-D'-E' placed on top of each other.

Basically a connecting device is also suitable for the simple electrical connection with only one single lead, whereby then a further lead could be connected at the projecting shaft of the device (contact pin) (for instance by means of a clamp). The most important application is, however, the interconnecting of cables such as for instance illustrated in FIGS. 1 and 2.

Figure 3:
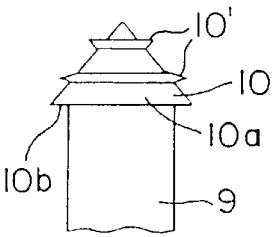
FIG. 3 depicts a pin point of a device according to the invention when including circumferential ribs.

FIG. 3 shows a pin point of the inventive device when including circumferential ribs 10*a*.

While there are shown and described present preferred embodiments of the invention, it is to be distinctly understood that the invention is not limited thereto, but may be otherwise variously embodied and practiced within the scope of the following claim.

What is claimed is:

1. A device for electrically connecting fine wire core leads in cables which comprises a shaft having a first diameter and first and second pin points at opposite ends of said shaft, said first and second pin points each including circumferential ribs and defining bases with diameters larger than said first diameter so as to define respective shoulders, and an annular abutment flange on said shaft at a location between said first and second pin points for determining a maximum depth of insertion of each of said first and second pin points into a cable.

2. A device according to claim 1, wherein said device is made of copper.

3. A combination of first and second flat band cables which each contain fine wire core leads, and a device for electrically connecting a fine wire core lead in the first cable with a fine wire core lead in the second cable, said device comprising a shaft having a first diameter and first and second pin points at opposite ends of said shaft, said first and second pin points each including circumferential ribs and defining bases with diameters larger than said first diameter so as to define respective shoulders, and an annular abutment flange on said shaft at a location between said first and second pin points for determining a maximum depth of insertion of each of said first and second pin points into a cable.

* * * * *